US007968778B2

(12) United States Patent
D'Addario et al.

(10) Patent No.: US 7,968,778 B2
(45) Date of Patent: Jun. 28, 2011

(54) TUNER WITH CAPO

(75) Inventors: James D'Addario, Old Westbury, NY (US); Richard Ned Steinberger, Nobleboro, ME (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 12/798,535

(22) Filed: Apr. 6, 2010

(65) Prior Publication Data

US 2010/0269666 A1 Oct. 28, 2010

Related U.S. Application Data

(60) Provisional application No. 61/214,759, filed on Apr. 28, 2009.

(51) Int. Cl.
*G10D 3/00* (2006.01)

(52) U.S. Cl. ..... 84/312 R; 84/318

(58) Field of Classification Search ..... 84/173, 84/312 R, 290, 317, 318
See application file for complete search history.

(56) References Cited

U.S. PATENT DOCUMENTS

| | | | | |
|---|---|---|---|---|
| 4,475,433 | A | 10/1984 | Williamson et al. | 84/318 |
| 5,131,307 | A | 7/1992 | Castillo | 84/267 |
| 5,275,079 | A | 1/1994 | Castillo | 84/318 |
| 5,563,358 | A | 10/1996 | Zimmerman | 84/477 R |
| 5,859,378 | A | 1/1999 | Freeland et al. | 84/454 |
| 5,886,270 | A | 3/1999 | Wynn | 84/313 |
| 5,959,229 | A | 9/1999 | Walley | 84/454 |
| 6,008,441 | A | 12/1999 | Steinberger | 84/318 |
| 6,107,554 | A | 8/2000 | Riddle | 84/300 |
| 6,417,435 | B2 | 7/2002 | Chantzis et al. | 84/477 R |
| 6,965,067 | B2 | 11/2005 | Kondo | 84/455 |
| 7,109,405 | B2 | 9/2006 | Brown | 84/318 |
| 7,858,865 | B2 * | 12/2010 | D'Arco | 84/454 |

* cited by examiner

*Primary Examiner* — Kimberly R Lockett
(74) *Attorney, Agent, or Firm* — Alix, Yale & Ristas, LLP

(57) ABSTRACT

A combination of a capo with attached tuner having a sensor that picks up vibrations through the capo. The capo and tuner are connected together as a unitary accessory that is attachable along the neck of the guitar, in the manner of a conventional capo, but with the significant advantage of automatic and continuous visibility of the tuner display while tuning at a particular capo position and while pausing between songs.

21 Claims, 7 Drawing Sheets

TUNER WITH CAPO

This application claims the benefit under 35 U.S.C. 119(e) of U.S. Provisional App. No. 61/214,759 filed Apr. 28, 2009 for, "Tuner With Capo".

BACKGROUND

Guitarists use electronic tuners to adjust the instrument to a standard or selected reference pitch, and can place capos in various positions on the guitar neck to change the pitch of all the strings on the instrument. Capos allow the use of chords or different chord versions that would not be available to the musician if he tried to play them without the capo. The use of a capo enables the musician to use chords in positions that include more open string combinations. Open strings tend to have unique sound characteristics that are desirable in many musical situations.

For ideal performance, the musician should re-tune the instrument after repositioning the capo. Many performers will take the stage with both a capo and a tuner in hand. This can be cumbersome to the artist and distracting to the audience.

There are many types of tuners available on the market. Each one directly or indirectly senses the vibrating string, processes the sensed audio signal to determine the closest corresponding note, and then compares the actual pitch of the string to the target tuning pitch. A display interface shows the user if the note is flat or sharp and the user tunes the string until he gets and in-tune indication from the tuner display. Tuner displays are typically LED lights, an analog needle mete, or an LCD or other digital graphic display device.

The audio signal from the instrument can be input into the tuner three ways. Some tuners have an input jack to directly wire the instrument to the tuner. Electric guitars or acoustic guitars with pickups (built in magnetic, piezo or microphone sensors) can be wired directly into the tuner. Some tuners use a built in microphone to pick up the signal. This is effective in quiet room conditions and for acoustic instruments. Noisy settings such as concert halls, studios, classrooms, and the like make it difficult to use a tuner in microphone mode. Some tuners clamp onto the instrument and utilize a built in sensor (usually a piezo type pickup) to pick up the vibrations in the guitar neck.

A plugged in version is the most efficient as the input signal is directly coupled to the input circuit of the tuner and no ambient noise will affect the sensitivity or accuracy of the signal recognition. The disadvantages are that the tuner must be plugged in. This can be an inconvenience or simply not possible in certain stage, recording or practice conditions. Serious musicians are reluctant to run their signal through a tuner and then into their amplification devices because deterioration of the audio signal is always possible when additional devices are wired into the signal path.

Tuners with a microphone input can be very effective also, but ambient room noise can confuse the input circuitry of the tuner giving erroneous readings. Using a microphone input tuner in a stage or studio environment is not practical.

Clip-on type tuners that use a sensor and pick up the vibrations from the guitar body can be very effective. If designed properly they can be as sensitive as a direct wired version and can work well in noisy environments. They are also very convenient. They can be kept in a pocket or clipped on to the headstock of the guitar when not being used.

SUMMARY

The inventive concept is to provide the combination of a capo with attached tuner having a sensor that picks up vibrations through the capo. The capo and tuner are connected together as a unitary accessory that is attachable along the neck of the guitar, in the manner of a conventional capo, but with the significant advantage of automatic and continuous visibility of the tuner display while tuning at a particular capo position and while pausing between songs.

In one embodiment, the tuner can be purchased as a standalone item that is adapted to be retrofitted onto one or more standard capos.

There are at least three benefits that the performer will realize using this invention.

The performer will need only one tool on stage, in studio or while practicing.

The tuner functions efficiently and accurately when used in conjunction with the capo. The clamping force of the capo makes a strong connection with the guitar neck and efficiently transmits the string vibrations to the sensor in the tuner that is mounted on the capo. Ambient noise does not degrade the tuning. Tuning can be efficiently achieved upon placing the capo anywhere on the neck. The capo can also be stored on the headstock when not being used as a capo. The tuner will function perfectly as a stand alone, clip-on type tuner when stored on the headstock.

It is very common for an artist to make minor adjustments in tuning after installing or moving a capo to a different position on the guitar neck. Having the tuner right at the capo where his hand is during installation will make it very convenient and easy for him or her to re-tune quickly and perfectly after each move of the capo. It will not be necessary to clip on a tuner or reach up to the headstock if he is using a clip-on type tuner to turn the unit on. The artist can capo the strings and tune them very quickly without having to interrupt his performance.

DRAWING

DESCRIPTION

Figure 1:
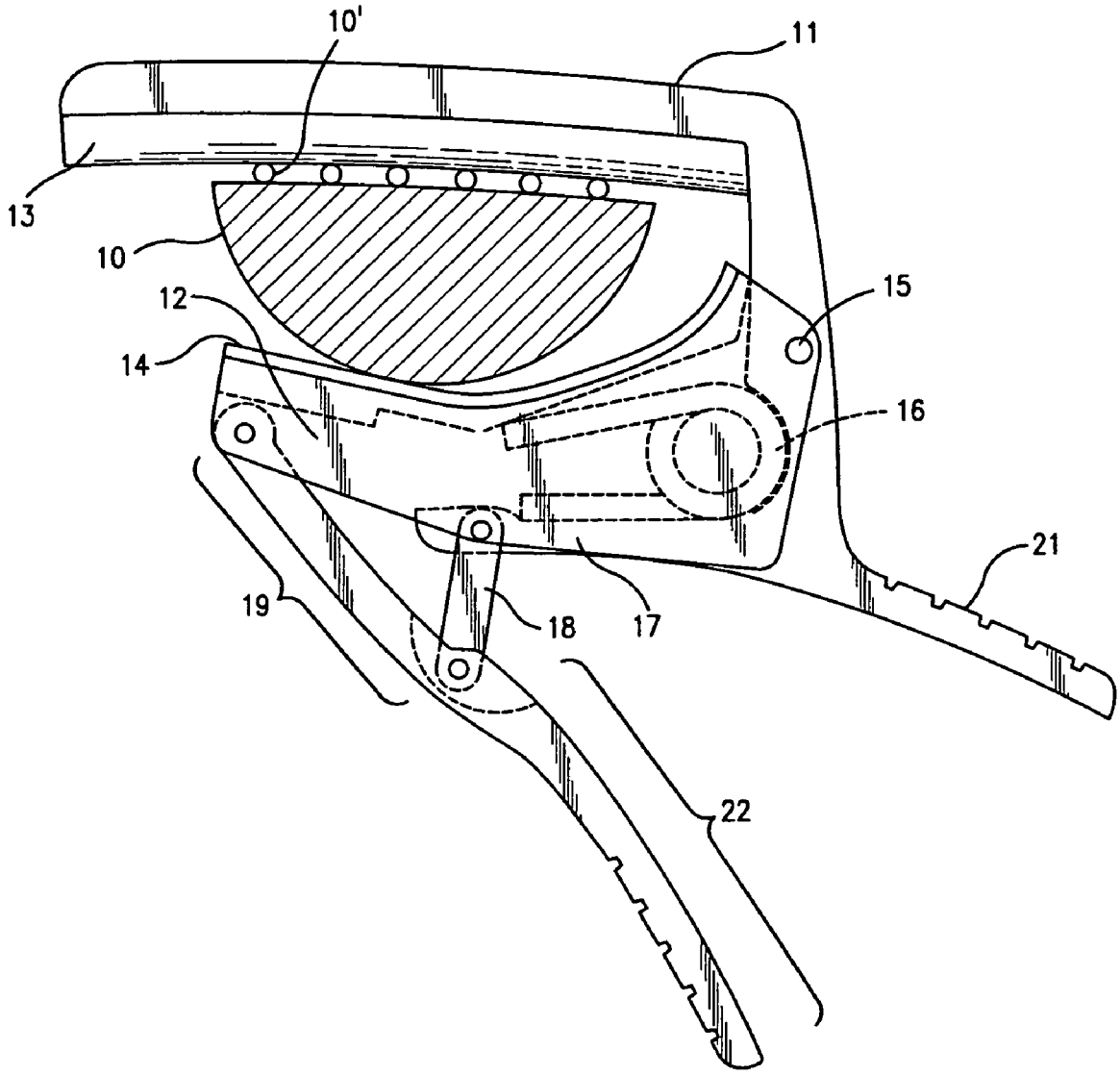
FIG. 1 (PRIOR ART)
FIG. 1 shows one type of known professional quality capo.

FIG. 1 shows a capo as described in U.S. Pat. No. 6,008,441, the disclosure of which is hereby incorporated by reference. The neck 10 of a guitar (including strings 10') is clamped between top jaw 11 and bottom jaw 12. The jaws (11 and 12) are both preferably lined with elastomeric pads (13 and 14), pad 13 assuring that all of the strings are clamped to the neck, and both pads preventing the neck from being marred. The bottom jaw 12 wraps partially around, and is pivotally attached to the shank of top jaw at pin 15. Torsion spring 16 bears against the foot 17 extending from the shank of top jaw 11 and the inside of bottom jaw 12, tending to close the jaws, and thereby apply clamping pressure to the guitar neck.

The force to open the jaws is provided by a hand operated two bar toggle type linkage comprising link 18 and link 19 on graspable arm 22. While link 18 and link 19 comprise a toggle type of linkage, the motion is such that the linkage does not actually toggle, since the jaws are fully open before the two elements which form the toggle are aligned. This type of linkage is used to provide a reducing force requirement as the jaws are opened, but the links do no cross over, i.e., the force does not go to zero and become negative, as in usual toggle applications.

To open the capo, finger pressure is applied to arm 22 (which projects from link 19) and arm 21 (which projects from jaw 11). As graspable arm 22 approaches arm 21, link 18 rotates to become closer to aligning with graspable arm 22, and the opening force required correspondingly decreases, even while the spring 16 exerts increasing force. Hence, relatively little actuating force is required maintain the capo open, and the musician can position it on the instrument without having to exert excessive force.

In the combination 20 of capo and tuner according to FIGS. 2-7, the torsion spring has been replaced by a coil spring 21 that extends perpendicularly from the lower jaw 12 in parallel with an extension of the shank 11' of the upper jaw 11, and the upper end of link 18 is connected to a short stem 12' extending from lower jaw 12. The tuner 23 has a front end that firmly receives the shank 11' such that vibrations in the shank can be transmitted to a sensor within the tuner body 25. A tuner circuit is located within the body and a tuner display, such as a plurality of lights, is visible on the body. The tuner body preferably extends from the shank 11' in parallel with the spring 21.

Figure 2:
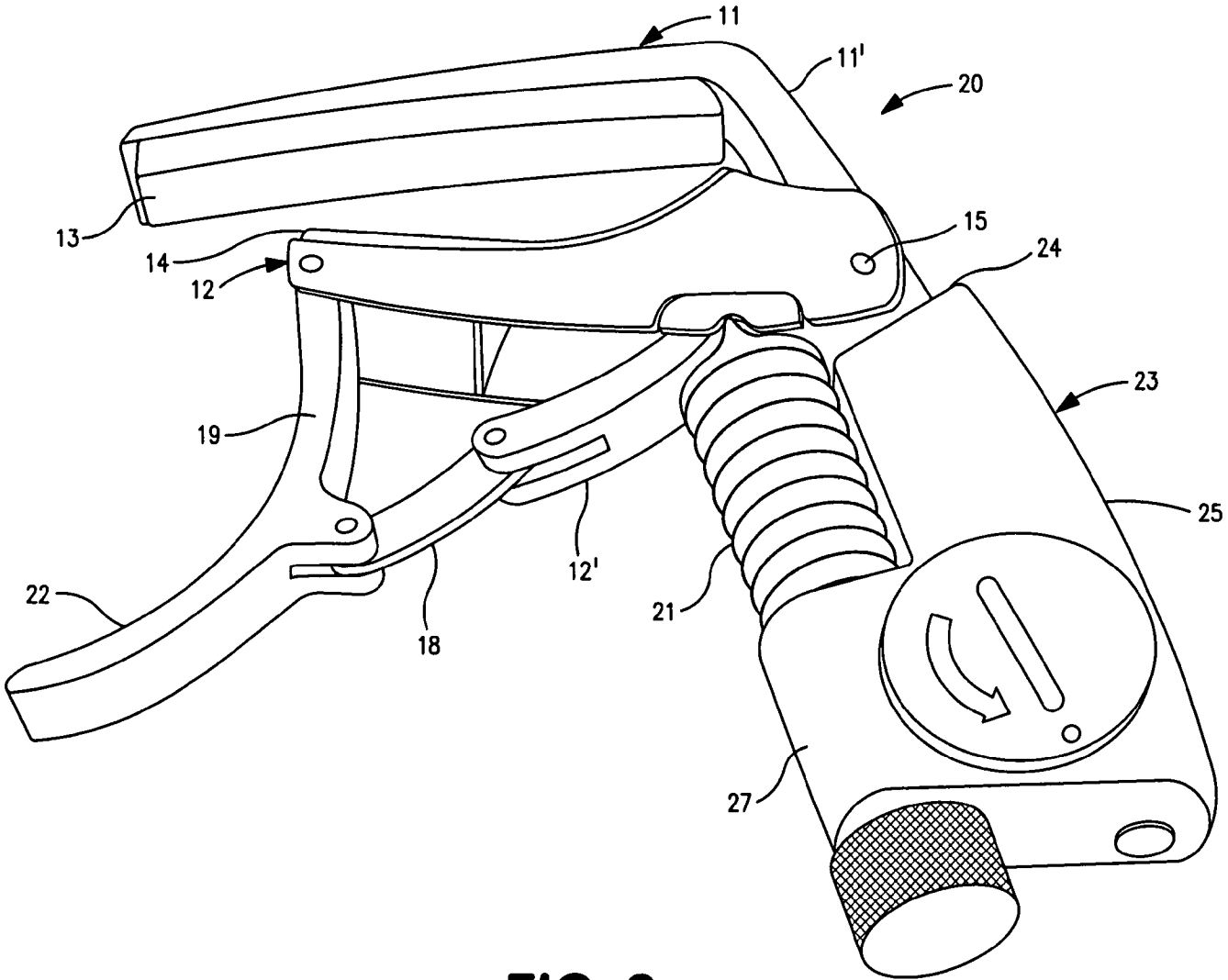
FIG. 2 shows an embodiment of the present invention as a combination of a tuner integrated with a capo of the type shown in FIG. 1, with the open side of capo facing to the left and the tuner on the right.
Figure 3:
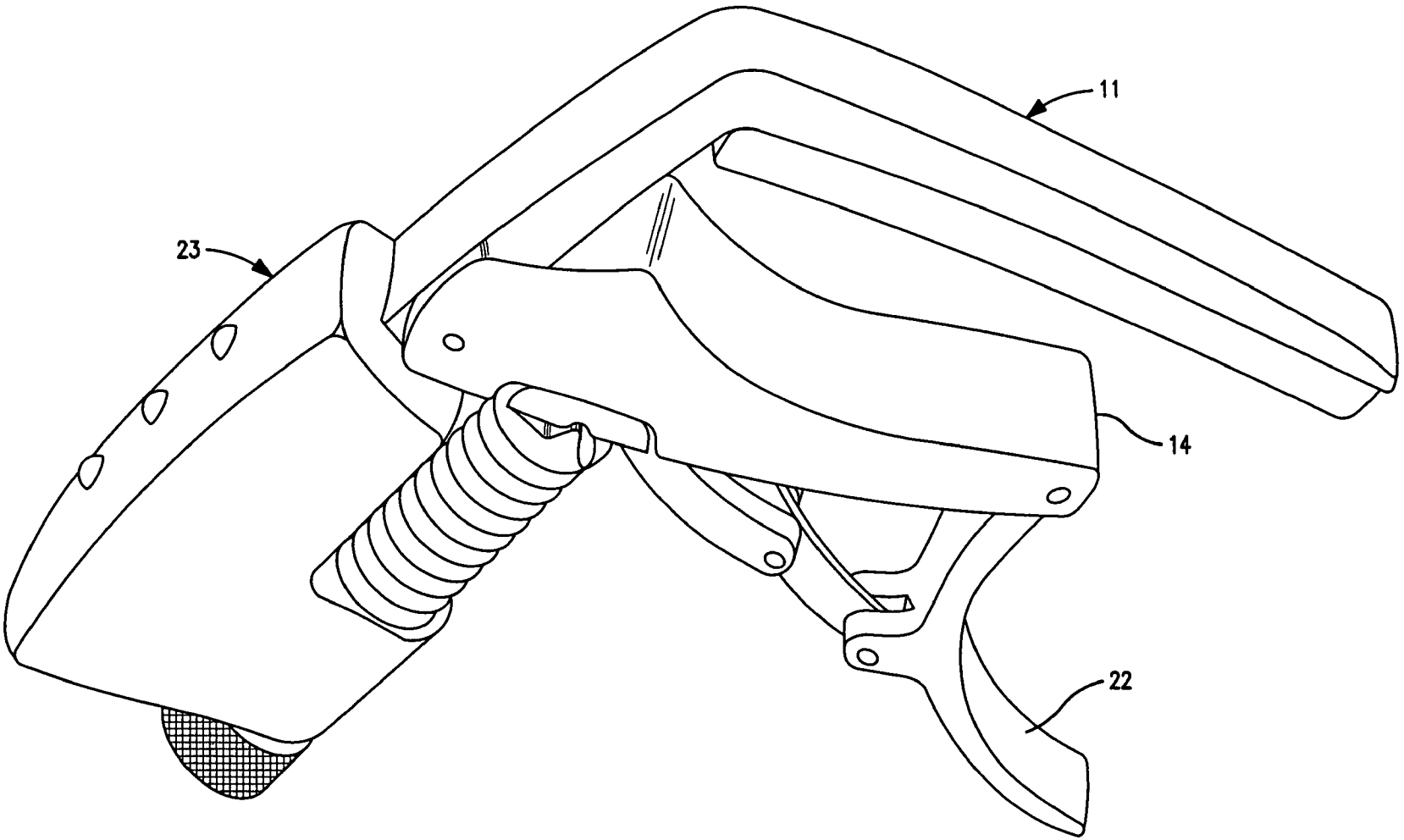
FIG. 3 shows the combination of tuner and capo of FIG. 2, but from a different view in which the open side of the capo faces to the right and the tuner is on the left.
Figure 4:
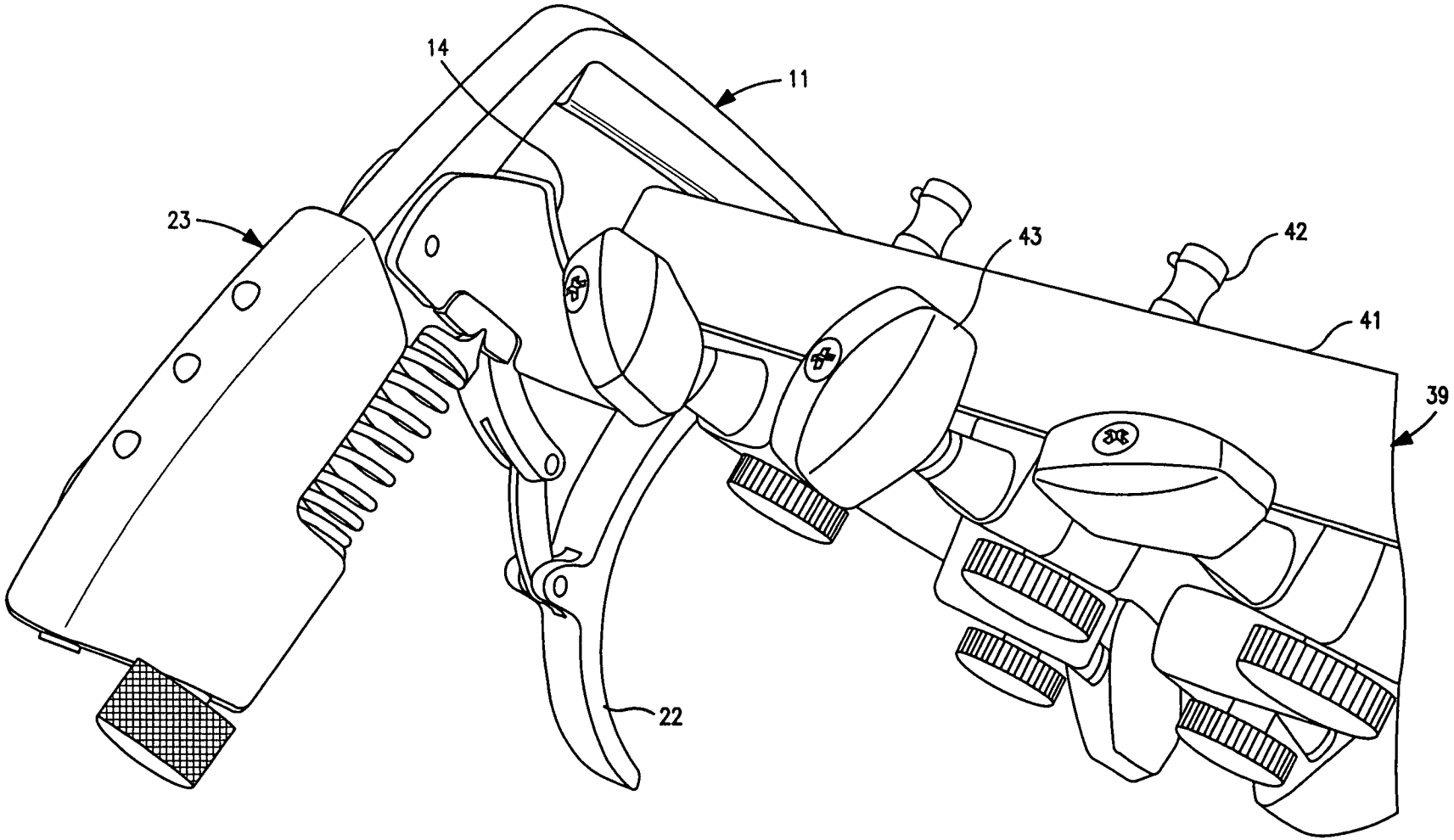
FIG. 4 shows the combination capo and tuner of FIG. 4, installed on the headstock of a guitar.
Figure 5:
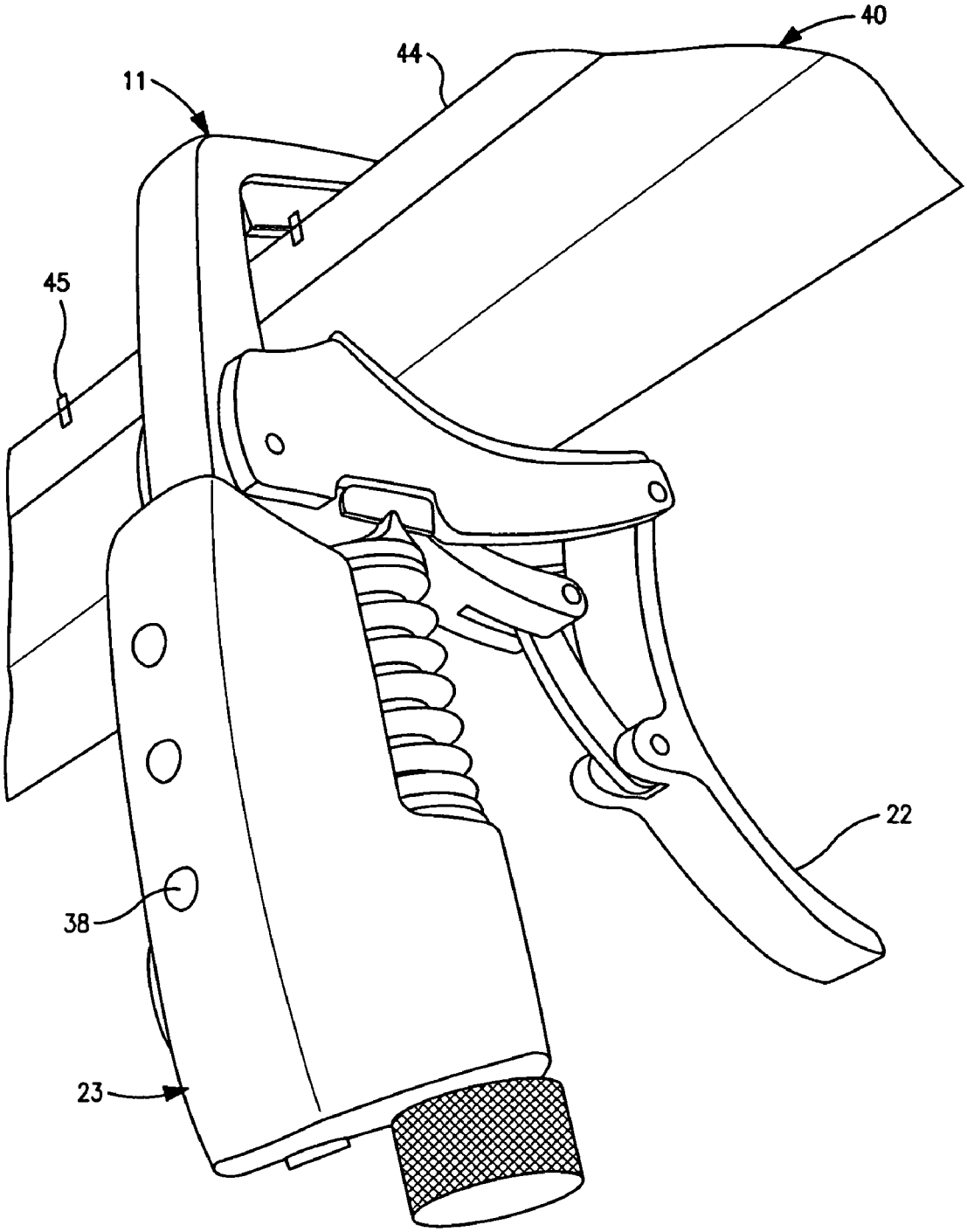
FIG. 5 shows the combination of capo and tuner of FIG. 3 installed on the neck of a guitar.

FIGS. 2-3 show the inventive combination 20 in different views while off the instrument and FIGS. 4-5 show it while mounted in the alternative play/tuning positions on the headstock 39 and the neck 40 of the guitar, respectively.

As is well known, the headstock 39 has a top surface 41 on which the strings (not shown) engage heads or pegs 42, which can be turned by respective tuning keys or winders 43. The neck 40 has a fret board 44 on its upper surface, with spaced apart frets 45.

Figure 7:
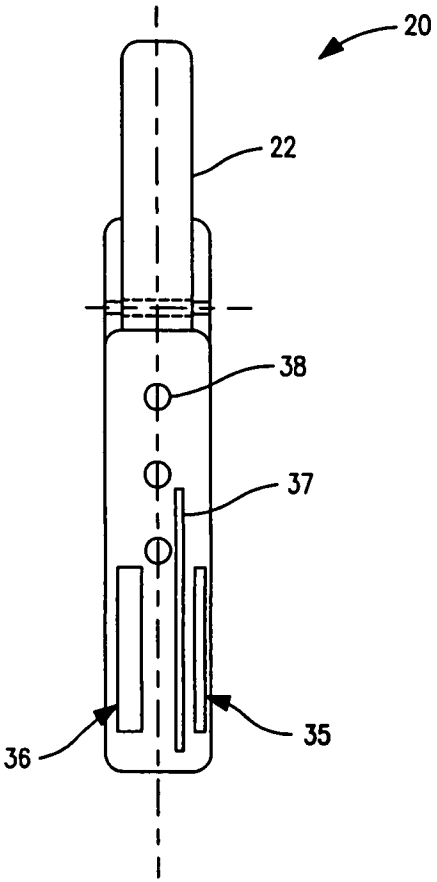
FIG. 7 is a view of the device of FIG. 6, from right.
Figure 6:
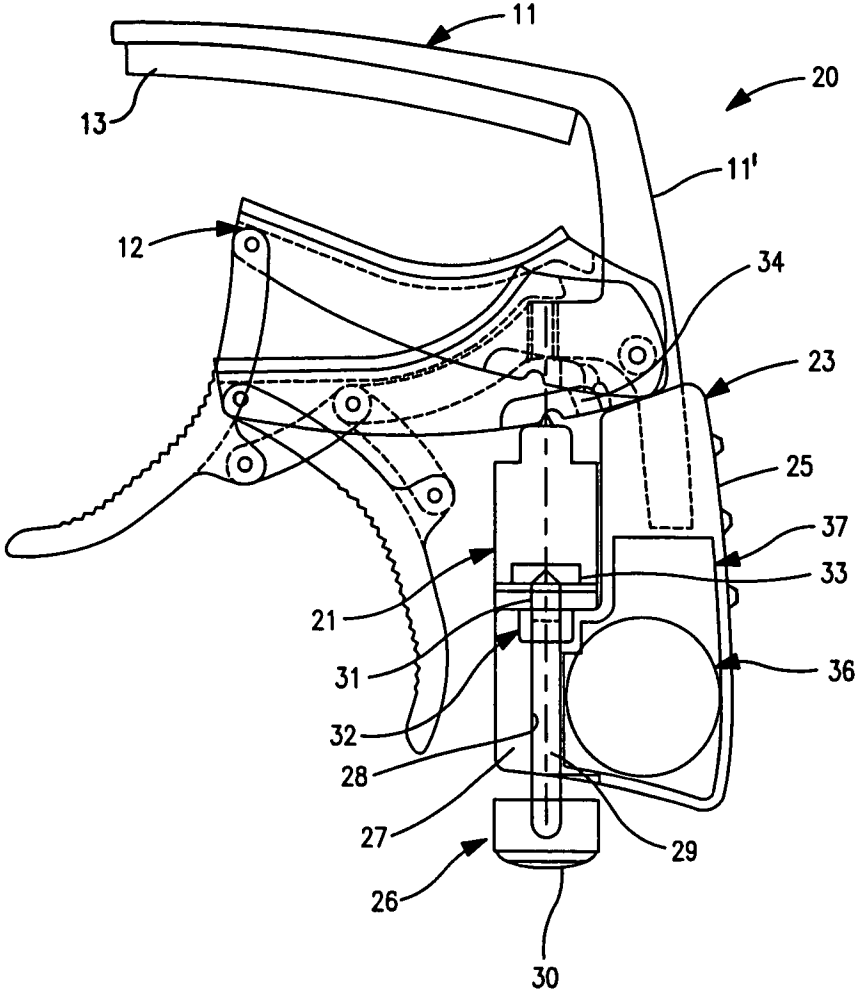
FIG. 6 is a view similar to FIG. 2, partially cut away to show how the tuner is connected to the capo.

FIGS. 6 and 7 show details of how the tuner 23, spring 21, and spring tension adjusting bolt 26 are preferably configured in a compact yet functional manner. The tuner body has an integral boss or the like 27 extending through the axis of the coil spring 21. A bore 28 in the boss receives the shank 29 of bolt 26, with the bolt head 30 accessible at one end of the boss and the threaded tip 31 of the bolt passing through a threaded insert 32 at the other end of boss. The tip of the bolt carries a disc 33 or the like that provides a seat for the coil spring. The other end of the spring bears on a seat 34 that is fixed with respect to the lower jaw 12. The bolt 26 can thus adjust the neutral length of the spring and the leverage forces associate with the linkages that open and close the capo jaws. In this embodiment, there is no need for the upper jaw 11 to have a foot (see item 17 of FIG. 1) to rigidly support one end of the spring, because the equivalent function is provided by the seat 33 which is supported by the shank 11' of upper jaw 11 through the intermediary structure of the tuner 23 and bolt 26. The tuner 23 is held in place by the close fit of the extension into the body 25 of the upper jaw shank 11' and the connection of the threads of the bolt 26 to the threaded insert 32 which is rigidly connected to the boss 27.

The tuner 23 has a sensor or transducer such a piezo device 35 to detect mechanical vibration that originates with a plucked string and is transmitted through the capo, especially the upper jaw 11 via the shank 11', to the tuner 23. The detected waveform is analyzed by a printed circuit board or the like 37 powered by battery 36, and the resulting tuning figure of merit is displayed as by a light pattern at 38. As can be appreciated from FIGS. 4, 5 and 6, the light pattern is readily visible to the artist when the capo is mounted to the neck or headstock of the guitar. The figure of merit typically indicates whether the string is too sharp or too flat, and may also indicate the degree of deviation from the target pitch.

Figure 8:
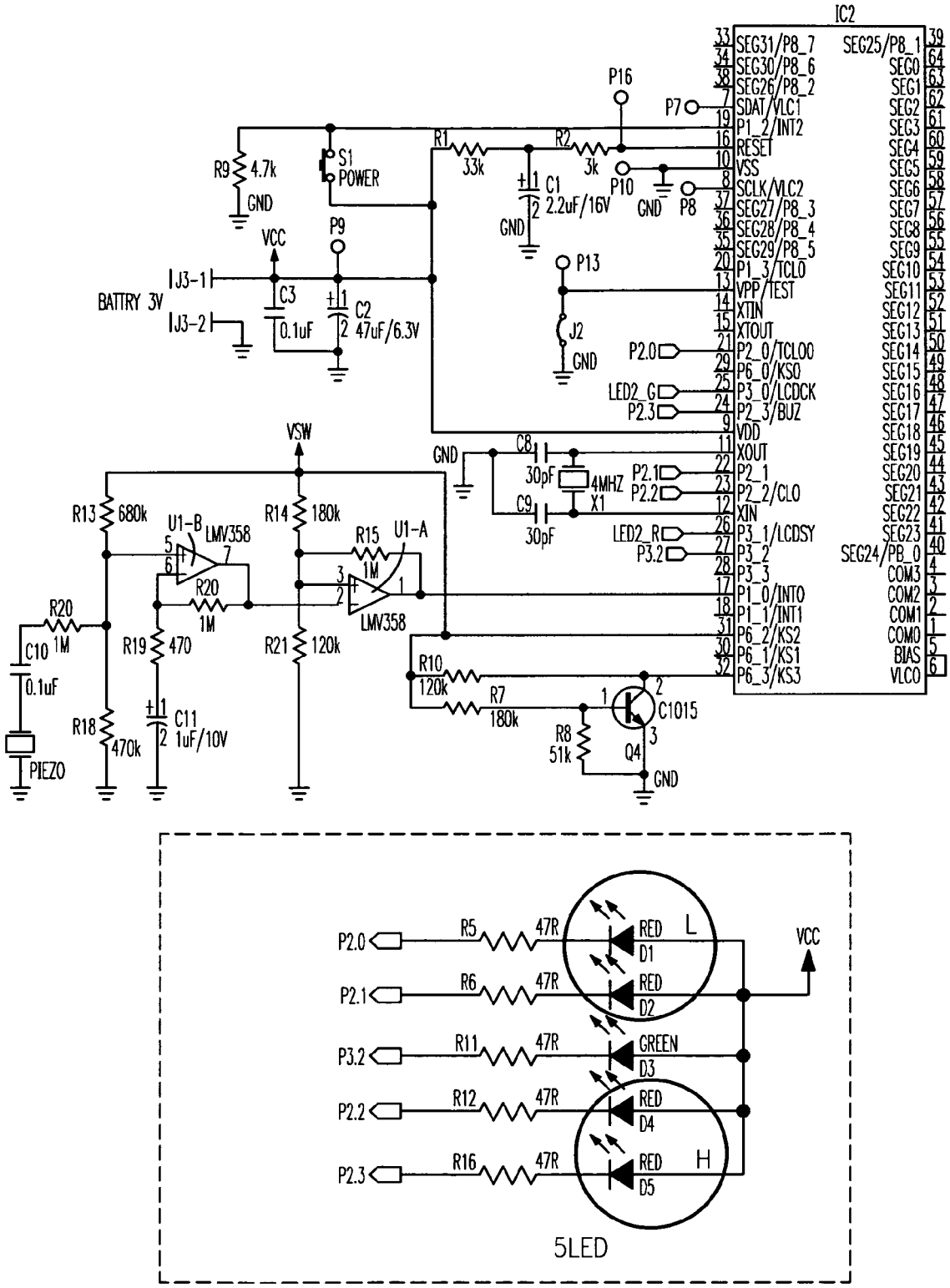
FIG. 8 is a schematic of a tuning circuit suitable for implementing the present invention.

FIG. 8 shows a representative tuning circuit for analyzing mechanical vibration of a stringed instrument. One of ordinary skill in the relevant field can readily incorporate this or other known tuner circuits into the tuner described above.

The invention claimed is:

1. A combination capo and tuner, comprising a capo connectable to the neck or headstock of a stringed instrument with sufficient contact to mechanically transmit a spectrum of mechanical vibrations commensurate with the acoustic vibration of a string; and a tuner mechanically integrated with the capo and including a sensor such that mechanical vibrations transmitted through the capo are received by the sensor, and a tuning display system coupled to the sensor that displays a tuning figure of merit commensurate with the acoustic vibration of the string wherein, the capo has a top jaw, spaced apart from a bottom jaw, and an actuator for selectively moving the jaws closer and farther apart, thereby securing the capo on and releasing the capo from the neck or headstock;

at least one of the jaws is supported on a rigid shank; and the shank engages the tuner.

2. The combination capo and tuner of claim 1, wherein the shank is integral with the upper jaw;

the lower jaw is pivotally connected to the shank;

the tuner has a body aligned with the shank; and the shank is within the tuner body.

3. The combination capo and tuner of claim 2, wherein the shank is oriented transversely to the upper jaw and lower jaw;

the body has an upper side facing away from the lower jaw and aligned with the shank; and said tuning figure of merit is displayed on said upper side of the body.

4. The combination capo and tuner of claim 3, including a coil spring biasing the lower jaw toward the upper jaw at a location adjacent to the pivot connection to the shank.

5. The combination capo and tuner of claim 4, wherein the coil spring extends perpendicularly from the lower jaw in parallel with an extension of the shank of the upper jaw.

6. The combination capo and tuner of claim 2, wherein the body has a lower side;

a coil spring is mounted on the tuner body and extends longitudinally adjacent the bottom side; and said spring biases the lower jaw toward the upper jaw.

7. The combination capo and tuner of claim 6, wherein the coil spring biases the lower jaw at a location adjacent to the pivot connection to the shank.

8. The combination capo and tuner of claim 7, wherein the coil spring extends perpendicularly from the lower jaw in parallel with an extension of the shank of the upper jaw.

9. The combination capo and tuner of claim 2, wherein the tuner has a front end that firmly receives the shank;

the tuner circuit is within the body; and the sensor is mounted within the body such that vibrations in the shank are transmitted to the sensor within the body.

10. The combination capo and tuner of claim 2, wherein the tuner body has an integral boss extending through the axis of the coil spring;

a bore in the boss receives a bolt, having a head accessible at one end of the boss and a threaded tip passing through a threaded insert at the other end of boss;

the tip of the bolt carries a disc that provides a seat for one end of the coil spring;

the other end of the spring bears on a seat that is fixed with respect to the lower jaw; whereby the bolt adjusts the neutral length of the spring and thereby the bias force on the lower jaw; and the tuner is secured to the capo by a close fit of the extension into the body of the upper jaw shank and the connection of the threads of the bolt to the threaded insert which is rigidly connected to the boss.

11. The combination capo and tuner of claim 10, wherein the lower jaw has an outer end opposite the pivot connection to the shank;

and an inner end at the pivot connection to the shank; and the actuator comprises a graspable arm having a first end forming a link with the outer end of the lower jaw and a free second end; and a second link and a third link extending from between the first and second ends of the arm to the inner end of the lower jaw.

12. The combination capo and tuner of claim 11, wherein the second link has a pivot connection between the first and second ends of the arm and a pivot connection to the third link; and the third link bears on the lower jaw at the seat for the coil spring.

13. The combination capo and tuner of claim 1, including a spring biasing the lower jaw toward the upper jaw.

14. The combination capo and tuner of claim 13, wherein the spring is a coil spring that biases the lower jaw at a location adjacent to the pivot connection to the shank.

15. The combination capo and tuner of claim 14, wherein the coil spring extends perpendicularly from the lower jaw in parallel with an extension of the shank of the upper jaw.

16. The combination capo and tuner of claim 15, including a bolt with exposed head operatively connected to the coil spring adjacent the tuner whereby turning of the head adjusts the length of the spring before the jaws are actuated and thereby the bias force on the lower jaw.

17. The combination capo and tuner of claim 16, wherein the lower jaw has an outer end opposite the pivot connection to the shank; and an inner end at the pivot connection to the shank; and the actuator comprises a graspable arm having a first end forming a link with the outer end of the lower jaw and a free second end; and a second link and a third link extending from between the first and second ends of the arm to the inner end of the lower jaw.

18. The combination capo and tuner of claim 17, wherein the second link has a pivot connection between the first and second ends of the arm and a pivot connection to the third link; and the third link bears on the lower jaw at the seat for the coil spring.

19. The combination capo and tuner of claim 5, including a bolt with exposed head operatively connected to the coil spring adjacent the tuner whereby turning of the head adjusts the length of the spring before the jaws are actuated and thereby the bias force on the lower jaw.

20. The combination capo and tuner of claim 1, wherein the shank is integral with and extends substantially perpendicularly to one jaw;

the actuator includes a spring that pivotally biases the other jaw toward said one jaw and an arm that pivots said other jaw away from said one jaw;

a tuner body is integrated with the shank; and the tuner is within the tuner body.

21. The combination capo and tuner of claim 20, wherein the arm is spaced from the shank and moved toward the shank to pivot said other jaw away from said one jaw.

* * * * *